US011553785B1

(12) United States Patent
Marks et al.

(10) Patent No.: US 11,553,785 B1
(45) Date of Patent: Jan. 17, 2023

(54) TOOTHPASTE DISPENSING PEN STYLE TOOTHBRUSH

(71) Applicants: Alexander Marks, Birmingham, AL (US); Carole Marks, Birmingham, AL (US)

(72) Inventors: Alexander Marks, Birmingham, AL (US); Carole Marks, Birmingham, AL (US)

( * ) Notice: Subject to any disclaimer, the term of this patent is extended or adjusted under 35 U.S.C. 154(b) by 0 days.

(21) Appl. No.: 17/393,699

(22) Filed: Aug. 4, 2021

(51) Int. Cl.
*A46B 9/04* (2006.01)
*A46B 11/00* (2006.01)
*A46B 15/00* (2006.01)

(52) U.S. Cl.
CPC ..... *A46B 11/0031* (2013.01); *A46B 9/04* (2013.01); *A46B 15/0095* (2013.01); *A46B 2200/1066* (2013.01)

(58) Field of Classification Search
None
See application file for complete search history.

(56) References Cited

U.S. PATENT DOCUMENTS 2,053,145 A 9/1936 Hamel
4,408,920 A 10/1983 Walther
7,244,073 B2 * 7/2007 Trocino ..... A46B 11/0027 401/172
9,339,103 B1 * 5/2016 Watters ..... A46B 11/0044
2006/0072963 A1 * 4/2006 Thorpe ..... A46B 11/0024 401/277
2011/0013969 A1 * 1/2011 Allen ..... A46B 11/0089 401/270
2012/0103355 A1 * 5/2012 Bowie ..... A46B 11/001 401/175
2018/0168326 A1 * 6/2018 Davies-Smith ..... A46B 11/001
2019/0075921 A1 * 3/2019 Flynn ..... A46B 11/0086
2020/0281346 A1 * 9/2020 Talbott ..... A46B 11/0058
2022/0054373 A1 * 2/2022 Curtis ..... A61Q 11/00

* cited by examiner

*Primary Examiner* — Joseph J Hail
*Assistant Examiner* — Dana Lee Poon
(74) *Attorney, Agent, or Firm* — Sanchelima & Associates, P.A.; Christian Sanchelima; Jesus Sanchelima

(57) ABSTRACT

A toothpaste dispensing pen style toothbrush including a toothbrush head assembly, a housing assembly, and an electrical assembly is disclosed. These assemblies in conjunction with one another provide a simple solution to brushing your teeth. The housing assembly includes toothpaste stored therein. A screw rod is longitudinally mounted within the housing assembly. At a bottom portion of the screw rod is a screw cup. The screw cup travels the length of the screw rod when a button is pressed to actuate a battery powered motor that spins the screw rod. The screw cup then pushes the toothpaste out of the housing and into the toothbrush head assembly along a channel. The channel ends at an outlet on a toothbrush head. Thereby dispensing toothpaste onto toothbrush bristles. A user can place a cap over the toothbrush head assembly that resembles a pen cap.

7 Claims, 4 Drawing Sheets

TOOTHPASTE DISPENSING PEN STYLE TOOTHBRUSH

BACKGROUND OF THE INVENTION

1. Field of the Invention

The present invention relates to toothpaste dispensing pen style toothbrush and, more particularly, to a toothpaste dispensing pen style toothbrush that is battery powered.

2. Description of the Related Art

Several designs for toothpaste dispensing pen style toothbrush have been designed in the past. None of them, however, include a battery to power the distribution of toothpaste.

Applicant believes that a related reference corresponds to U.S. Pat. No. 4,408,920 issued for a pocket carried toothpaste dispensing toothbrush. Applicant believes another related reference corresponds to U.S. Pat. No. 2,053,145. None of these references, however, teach of a pen style toothbrush including a pen cap and battery.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a toothpaste dispensing pen style toothbrush that is modular.

It is another object of this invention to provide a toothpaste dispensing pen style toothbrush that is battery powered.

It is still another object of the present invention to provide a toothpaste dispensing pen style toothbrush that includes a pen top cover.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
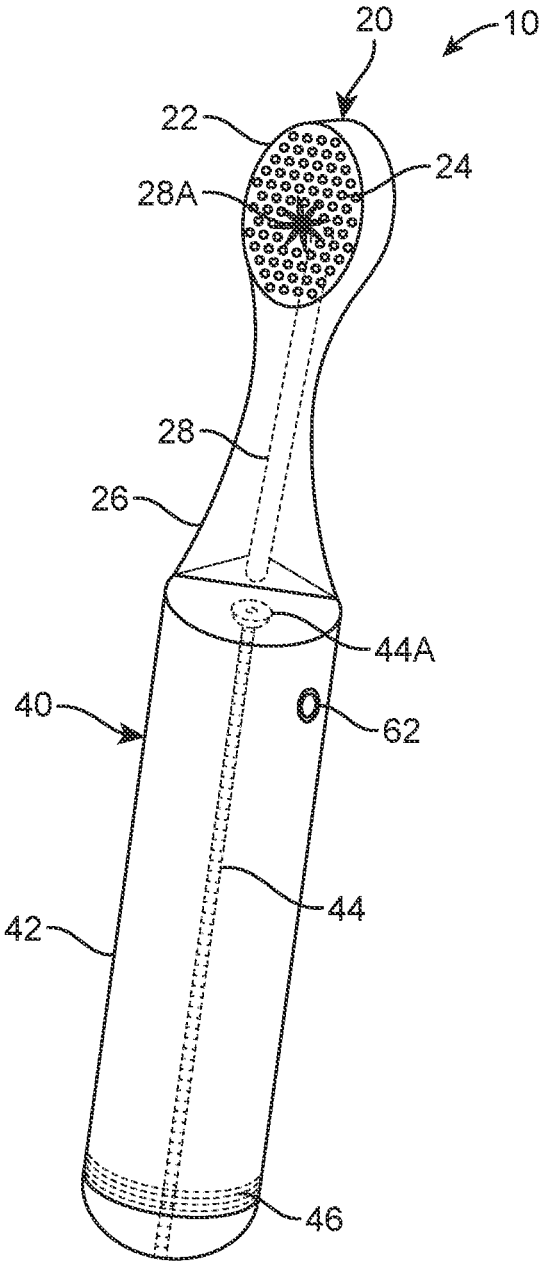
FIG. 1 includes dashed lines that represent an internal view of a toothbrush head assembly 20 mounted to the housing assembly 40.
Figure 2:
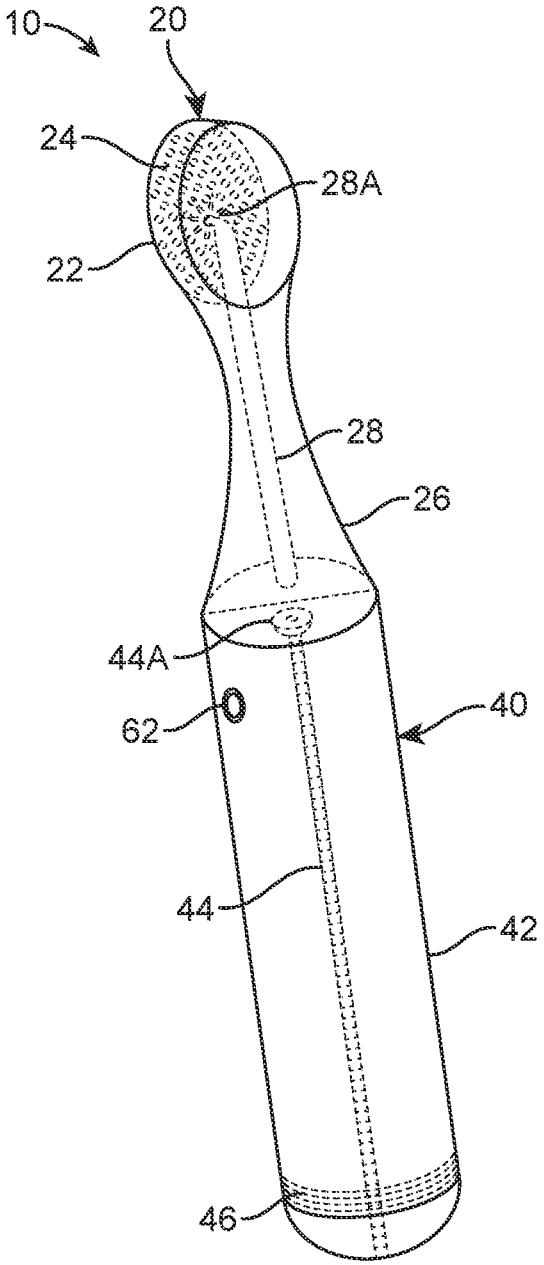
FIG. 2 shows a rear internal view of the head assembly 20. Wherein the channel 48 is shown to connect with the rear of outlet 28A.

Referring now to the drawings, where the present invention is generally referred to with numeral 10, it can be observed that it basically includes a toothbrush head assembly 20, a housing assembly 40, and an electrical assembly 60.

Best illustrated in FIG. 1 housing assembly 40 may include a housing 42. The housing 42 may be a hollow cylindrical tube with a rounded bottom portion and an open top portion. The housing 42 includes an interior that may serve as a storage compartment for toothpaste, gels, or other viscous fluids. The housing 42 may further include a screw rod 44. In one embodiment the screw rod 44 may be a threaded member longitudinally disposed about an interior of the housing 42. The screw rod 44 may include a screw cap 46 mounted thereon. The screw cap 46 may include a central threaded opening to facilitate the screw cap 46 traveling along a length of the screw rod 44. It may be suitable for the screw rod 44 to include a screw rod head 44A. The screw rod head 44A may be a flattened cylindrical member with a diameter greater than that of the screw rod 44. The screw rod head 44A may prevent the screw cap 46 from traveling past a distal end of the screw rod 44. In one embodiment a user may manually rotate the rounded bottom portion of the housing 42 about the axis of the screw rod 44. The rotation of the rounded bottom portion, and by extension the screw rod 44, may allow for the upward and downward movement of the screw cap 46.

Figure 4:
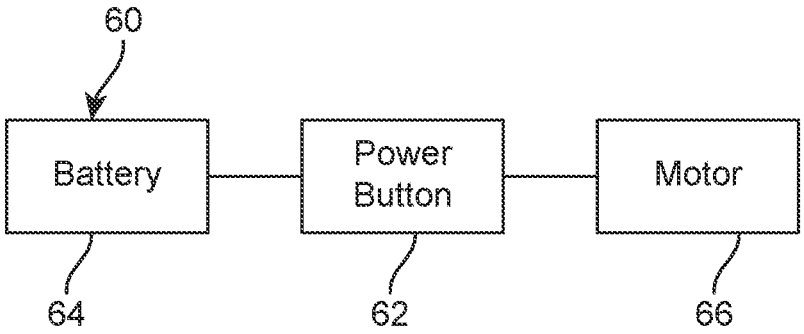
FIG. 4 illustrates an overview of electrical assembly 60.

In an alternate embodiment, best shown in FIGS. 1 and 4, the housing 42 may include a motor 66 that rotates the screw rod 44 when the power button 62 is pressed. The power button 62 may actuate the motor 66 using a battery 64 as a power source. The housing 42 may include a threaded portion about an interior top edge. The interior top edge of the housing 42 may receive a threaded bottom portion of the toothbrush head assembly 20.

Figure 3:
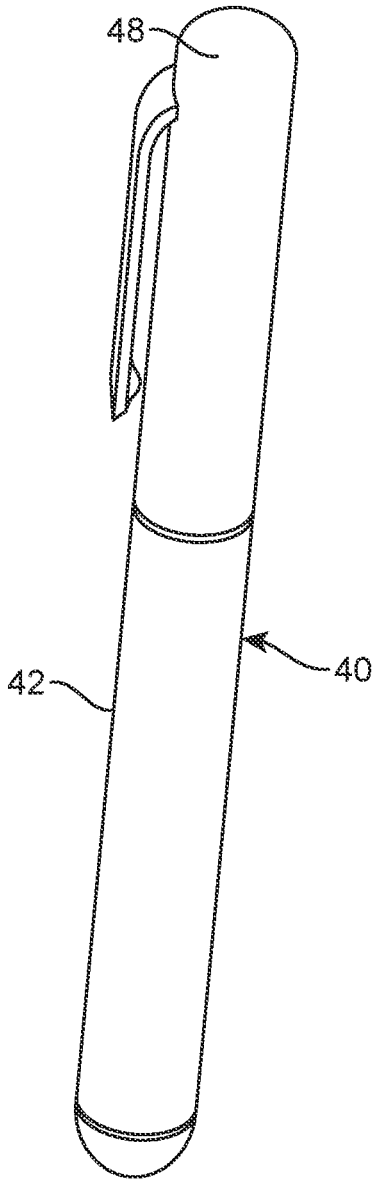
FIG. 3 shows the housing assembly 40 with a cap 48 mounted thereon.

Best illustrated in FIG. 1 toothbrush head assembly 20 may include a toothbrush head 22. The toothbrush head 22 may include a head portion. Wherein the head portion of the toothbrush head 22 may include bristles 24 disposed about a flat oblong portion mounted thereon. As the screw cap 46 travels the length of the screw rod 44 the contents of the housing 42 are forced upward toward the top end of said housing 42. When the contents of the housing 42 arrive at the top end they are funneled through a neck 26 of the toothbrush head assembly 20. It may be suitable for the flat oblong portion of the toothbrush head 22 to further include an outlet 28A. The outlet 28A is an opening by which the contents of the housing 42 may be dispensed after traversing the channel 28. The channel 28 may be a cylindrical longitudinal pathway extending from the bottom end of the neck 26 up to the outlet 28A. Referring now to FIG. 3, it may be suitable for the toothbrush head assembly 20 to be covered by a cap 48. The cap 48 may include a hollow cylindrical interior capable of encompassing the toothbrush head assembly 20. The cap 48 may further include a clip mounted to a lateral top end. Wherein said cap 48 may engage with an exterior of the top end of the housing 42 via pressure. The cap 48 may help create a more sanitary environment for the toothbrush head 22 by maintaining said toothbrush head 22 covered while not in use. The cap 48 also has the benefit of protecting a user from incidental spilling of the contents of the housing 42 via the outlet 28A.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a toothpaste dispensing pen style toothbrush, comprising:

a. a toothbrush head assembly including a toothbrush head, wherein said toothbrush head includes a neck, said head having an oval shape, the neck including a channel spanning a neck interior, wherein said channel is a cylindrical longitudinal pathway, wherein the channel extends from a neck bottom to an outlet, said outlet being surrounded by bristles, wherein said outlet is star shaped;

b. a housing assembly including a housing, wherein said housing includes a screw rod disposed about a housing interior, wherein said housing assembly includes a cap, said cap has a rod-like shape, the screw rod having a screw cap mounted thereon, wherein said housing is a hollow cylinder, wherein said housing has a top planar end, said housing has a bottom portion having hemispherical shape, wherein said bottom portion is hollow, wherein said screw rod exteds a length of said housing, wherein a bottommost end of said housing is in abutting contact with a top surface of said bottom portion; and c. an electrical assembly including a battery and a power button to actuate a motor, said motor facilitating the rotation of the screw rod to force the contents of said housing toward the outlet of the toothbrush head assembly, wherein said power button has a circular shape, said power button is mounted to a housing lateral side, said power button is proximal to an uppermost end of said housing nearest to the toothbrush head, said button is a push button.

2. A system for a toothpaste dispensing pen style toothbrush of claim 1 wherein said bristles are equidistantly mounted to a flat oblong portion of the toothbrush head.

3. A system for a toothpaste dispensing pen style toothbrush of claim 1 wherein said screw cap includes a central threaded opening to facilitate the screw cap traveling a length of the screw rod.

4. A system for a toothpaste dispensing pen style toothbrush of claim 1 wherein said cap includes a hollow cylindrical body that encompasses the toothbrush head assembly by engaging with the top end of the housing.

5. A system for a toothpaste dispensing pen style toothbrush of claim 4 wherein said cap includes a clip mounted to a top end adapted to resemble a pen cap, said clip extends downwardly from a top portion of said pen cap.

6. A system for a toothpaste dispensing pen style toothbrush, comprising:

a. a toothbrush head assembly including a toothbrush head, wherein said toothbrush head includes a neck, the neck including a channel spanning a neck interior, wherein the channel extends from a neck bottom to an outlet, said outlet being surrounded by bristles, wherein said channel is a cylindrical longitudinal pathway, wherein said outlet is star shaped;

b. a housing assembly including a housing and a cap, wherein said housing includes a screw rod disposed about a housing interior, the screw rod having a screw cap mounted thereon, the cap encompassing the toothbrush head assembly by engaging with the top end of the housing, the housing being a hollow cylinder, wherein said housing is a hollow cylinder, wherein said housing has a top planar end, said housing has a bottom portion having hemispherical shape, wherein said bottom portion is hollow; and c. an electrical assembly including a battery and a power button to actuate a motor, said motor facilitating the rotation of the screw rod to force the contents of said housing toward the outlet of the toothbrush head assembly, wherein said power button has a circular shape, said power button is mounted to a housing lateral side, said power button is proximal to an uppermost end of said housing nearest to the toothbrush head.

7. A system for a toothpaste dispensing pen style toothbrush, consisting of:

a. a toothbrush head assembly including a toothbrush head, wherein said toothbrush head includes a neck, the neck including a channel spanning a neck interior, wherein the channel is a cylindrical longitudinal pathway that extends from a neck bottom to an outlet, said outlet being and star shaped and surrounded by bristles, said bristles are mounted to a flat oblong portion of the toothbrush head;

b. a housing assembly including a housing and a cap, wherein said housing is a hollow cylinder that includes a screw rod disposed about a housing interior, the screw rod having a screw cap mounted thereon, the screw cap including a central threaded opening to facilitate the screw cap traveling a length of the screw rod, said screw rod further including a screw rod head located at a distal end, the screw rod head being a flattened cylindrical member with a diameter greater than that of the screw rod, the cap being a hollow cylindrical body with an open end and a closed end that encompasses the toothbrush head assembly by engaging with the top end of the housing, said cap including a clip mounted to a top end exterior adapted to resemble a pen cap, wherein said housing has a bottom portion having hemispherical shape, wherein said bottom portion is hollow; and c. an electrical assembly including a battery and a power button to actuate a motor, said motor facilitating the rotation of the screw rod to force the contents of said housing toward the outlet of the toothbrush head assembly, the power button being mounted to a housing lateral side, wherein said power button has a circular shape, said power button is mounted to a housing lateral side, said power button is proximal to an uppermost end of said housing nearest to the toothbrush head.

* * * * *